US010730724B2

(12) United States Patent
Shan et al.

(10) Patent No.: US 10,730,724 B2
(45) Date of Patent: Aug. 4, 2020

(54) WHEELED CRANE AND SELF-DEMOUNTING AND SELF-MOUNTING METHODS FOR SUPPORTING LEGS THEREOF

(71) Applicant: XUZHOU HEAVY MACHINERY CO., LTD., Xuzhou, Jiangsu Province (CN)

(72) Inventors: Zenghai Shan, Xuzhou (CN); Honggang Ding, Xuzhou (CN); Hao Shu, Xuzhou (CN); Li Li, Xuzhou (CN); Housheng Wang, Xuzhou (CN); Haibing Ji, Xuzhou (CN); Jing Jiang, Xuzhou (CN); Jianjun Song, Xuzhou (CN)

(73) Assignee: XUZHOU HEAVY MACHINERY CO., LTD., Xuzhou, Jaingsu Province (CN)

( * ) Notice: Subject to any disclaimer, the term of this patent is extended or adjusted under 35 U.S.C. 154(b) by 366 days.

(21) Appl. No.: 15/534,821

(22) PCT Filed: Dec. 11, 2015

(86) PCT No.: PCT/CN2015/097094
§ 371 (c)(1),
(2) Date: Jun. 9, 2017

(87) PCT Pub. No.: WO2016/091206
PCT Pub. Date: Jun. 16, 2016

(65) Prior Publication Data

US 2017/0362065 A1 Dec. 21, 2017

(30) Foreign Application Priority Data

Dec. 11, 2014 (CN) ..... 2014 1 0757535

(51) Int. Cl.
*B66C 23/78* (2006.01)
*B66C 23/34* (2006.01)
*B66C 23/36* (2006.01)

(52) U.S. Cl.
CPC ..... *B66C 23/78* (2013.01); *B66C 23/344* (2013.01); *B66C 23/365* (2013.01)

(58) Field of Classification Search
CPC ..... B66C 23/344; B66C 23/365; B66C 23/78; B66C 23/80; B66C 25/00; E02F 9/08; E02F 9/0808; E02F 9/085; B60S 11/00
See application file for complete search history.

(56) References Cited

U.S. PATENT DOCUMENTS 8,689,986 B2 4/2014 Richter

FOREIGN PATENT DOCUMENTS

CN 1693176 11/2005
CN 101880010 11/2010
(Continued)

OTHER PUBLICATIONS

Machine Translation of CN 203048460 (Year: 2013).*
(Continued)

*Primary Examiner* — Emmanuel M Marcelo
*Assistant Examiner* — Juan J Campos, Jr.
(74) *Attorney, Agent, or Firm* — Myers Bigel, P.A.

(57) ABSTRACT

A wheeled crane and self-demounting and self-mounting methods for supporting legs thereof is disclosed. The wheeled crane includes a vehicle frame and auxiliary supports, and the auxiliary supports can enable the vehicle frame to keep balance. Since the wheeled crane has auxiliary supports, when the supporting legs are demounted or mounted, the auxiliary supports function as supporting legs, so that the supporting legs can be mounted and demounted by the operation part of the wheeled crane with no need of
(Continued)

using an auxiliary crane, and thus the self-mounting and self-demounting of the supporting legs of the wheeled crane are realized.

3 Claims, 5 Drawing Sheets

(56) References Cited

FOREIGN PATENT DOCUMENTS

| | | |
|---|---|---|
| CN | 202924640 | 5/2013 |
| CN | 203048460 | 7/2013 |
| CN | 103318774 | 9/2013 |
| CN | 203699742 | 7/2014 |
| CN | 104444850 | 3/2015 |
| CN | 204324750 | 5/2015 |
| EP | 0 048 076 | 3/1982 |
| EP | 0 264 759 | 4/1988 |
| JP | 2000007282 | 1/2000 |

OTHER PUBLICATIONS

International Search Report and Written Opinion for PCT/CN2015/097094 dated Mar. 17, 2016 with translation of ISR, 13 pages.
Office Action for CN application No. 201410757535.3 dated Dec. 4, 2015, 8 pages.

* cited by examiner

WHEELED CRANE AND SELF-DEMOUNTING AND SELF-MOUNTING METHODS FOR SUPPORTING LEGS THEREOF

RELATED APPLICATIONS

The present application is a 35 U.S.C. § 371 national phase application of PCT International Application No. PCT/CN2015/0097094, filed Dec. 11, 2015, which claims priority to Chinese Patent Application No. 201410757535.3 filed Dec. 11, 2014, the disclosures of which are hereby incorporated herein by reference in their entireties.

FIELD OF THE INVENTION

The present invention relates to the field of engineering machinery, and in particular to a wheeled crane and self-demounting and self-mounting methods for supporting legs thereof.

BACKGROUND OF THE INVENTION

When travelling on roads, a wheeled crane needs to meet the requirements of bridge load limit. In accordance with the JB/T 6042-2006 Special Chassis for Truck Crane, the bridge loads of vehicles on roads should be less than or equal to 12 t; and based on the GB1589-2004 Limitations to Outline Dimensions, Shaft Loads and Masses of Road Vehicles, the total masses of the vehicles on roads should be less than or equal to 55 t. At present, the total weights of most large-tonnage wheeled cranes are large, and the bridge loads and the total weights all exceed the standard requirements. Therefore, before travelling on the roads, a part of or all of the supporting legs of these crane products need to be demounted, and the supporting legs are mounted prior to operation.

Specifically, when the wheeled crane is in operation, the crane and its accessories need to be transported to a work site in advance; after arriving at the work site, the components are assembled, and a lifting operation is carried out after the components are assembled. In general, small-tonnage wheeled cranes can arrive at operation sites in complete states, and the accessories or the like do not need to be transported by other auxiliary vehicles. However, the large-tonnage wheeled cranes have large total weights and numerous accessories, and thus the accessories need to be transported by the auxiliary vehicles. Referring to FIG. 1, FIG. 1 is a schematic diagram of a lifting operation state of a wheeled crane in the prior art. The wheeled crane includes a chassis 13, supporting legs 11, and an operation part 12, and the operation part 12 is used for lifting a weight 14.

Wheeled crane: a crane driven by wheels for travelling.

Main crane: a crane used for completing a main body lifting task.

Auxiliary crane: a crane assisting the main crane in completing the lifting operation, or a crane used for assembling the main crane.

Operation part: a part used for lifting weights on the crane, which mainly refers to a mechanism above the chassis of the crane.

Chassis: a part on the crane which is used for travelling and supporting the operation part of the crane, and meanwhile can provide support during a boarding operation of the operation part.

Supporting leg: a supporting mechanism during the operation of the wheeled crane and functioning to support the crane and the weights. Movable supporting legs need to stretch out or swing out to expand supporting spans during the operations of the crane, and meanwhile include vertical supporting mechanisms. According to whether the supporting legs need to extend and retract (or swing) prior to and after the operations, the supporting legs are divided into movable supporting legs and fixed supporting legs. According to different telescopic manners, the movable supporting legs include swing supporting legs and telescopic supporting legs.

At present, during the operations of the wheeled crane, supporting operations of the supporting legs are needed in general, and the supporting legs on the wheeled crane can be arranged in one of the following manners: an H-shaped supporting leg (referring to FIG. 2*a*), a K-shaped supporting leg (referring to FIG. 2*b*) and an X-shaped supporting leg (referring to FIG. 2*c*). The number of the supporting legs is mostly 4, and a fifth supporting leg is also added below the cabs of some products to facilitate front operations of the vehicles.

Referring to FIG. 2*a*, the H-shaped supporting leg contains four telescopic supporting legs 16 and four fixed supporting legs 17 in the front and back in total, the telescopic supporting legs 16 are arranged on the fixed supporting legs 17, and the fixed supporting legs 17 are connected with the vehicle frame. Referring to FIG. 2*b*, the K-shaped supporting leg contains two swing supporting legs 15 in the front, and two telescopic supporting legs 16 and two fixed supporting legs 17 in the back in total, wherein the telescopic supporting legs 16 are arranged on the fixed supporting legs 17, and the fixed supporting legs 17 are connected with the vehicle frame. Referring to FIG. 2*c*, the X-shaped supporting leg contains four swing supporting legs 15 in the front and back in total.

The telescopic supporting legs 16 and the swing supporting legs 15 need to stretch out or swing out to expand the supporting spans during the operations of the crane. The fixed supporting legs serve as guiding and connecting mechanisms of the telescopic supporting legs, and the swing supporting legs have no corresponding fixed supporting legs. The swing supporting legs are connected with the vehicle frame by pin shafts, and the fixed supporting legs can be connected with the vehicle frame by welding or the pin shafts. Referring to FIG. 3*a*, fixed supporting legs 31 are generally welded on the vehicle frame 32; and referring to FIG. 3*b*, the fixed supporting legs 31 of some cranes are connected with the vehicle frame 32 by pin shafts 33.

Before the cranes travel on the roads, some supporting legs need to be demounted, and the supporting legs are mounted prior to operations. The to-be-demounted supporting legs herein refer to one kind of the following legs: the telescopic supporting legs, the swing supporting legs and the fixed supporting legs which are detachably connected (wherein one common form is pin shaft connection).

Referring to FIG. 3*b*, the demounting and mounting methods of the fixed supporting legs connected with the vehicle frame by the pin shafts are described below: the demounting and mounting manners of the fixed supporting legs connected by the pin shafts include a hydraulic manner, a mechanical manner, an electrical manner and a pneumatic manner. In the hydraulic manner, the connected pin shafts 33 are demounted and mounted by a hydraulic cylinder so as to separate and connect the fixed supporting legs 31 and the vehicle frame 32. In the mechanical manner, the connected pin shafts 33 are mainly demounted and mounted manually or via other simple auxiliary tools so as to separate and connect the fixed supporting legs 31 and the vehicle frame 32. The electrical and pneumatic demounting and mounting processes are the same as those of the hydraulic manner. With respect to the demounting and mounting methods of the telescopic supporting legs and the swing supporting legs, reference can be made to the demounting manner of the fixed supporting legs connected by the pin shafts.

The demounting and mounting methods of the fixed supporting legs connected with the vehicle frame by the pin shafts are described below again: the demounting and mounting manners of the fixed supporting legs connected by the pin shafts include the hydraulic manner, the mechanical manner, the electrical manner and the pneumatic manner. In the hydraulic manner, the connected pin shafts 33 are demounted and mounted in the pin shaft holes 33*a* by the hydraulic cylinder so as to separate and connect the fixed supporting legs 31 and the vehicle frame 32. In the mechanical manner, the connected pin shafts 33 are mainly demounted and mounted manually or via other simple auxiliary tools so as to separate and connect the fixed supporting legs 31 and the vehicle frame 32. The connection manner thereof is as shown in FIG. 3*b*. The electrical or pneumatic demounting and mounting processes are the same as those of the hydraulic manner.

At present, the supporting legs on the main crane 41 are demounted and mounted by adopting an auxiliary crane 42 in the field of wheeled cranes. The traditional demounting and mounting operation states are shown in FIG. 4.

In the prior art, the specific implementation method and steps of demounting the supporting legs are as follows:

First step, the main crane stops in an area in which it is convenient for the operation of the auxiliary crane, and when the to-be-demounted supporting leg is at a conveniently demounted position. The connecting pipeline, oil cylinder and the like of the supporting leg and the vehicle frame are demounted.

Second step, the auxiliary crane arrives at a proper position, prepares for lifting, adjusts the operation part and lifts the to-be-demounted supporting leg. If the auxiliary crane is an irremovable crane, the auxiliary crane also needs to carry out such operations as adjusting the posture after arriving at the proper position.

Third step, in conjunction with the auxiliary crane, the pin shafts are manually pulled out or the pin shafts are pulled out by the hydraulic cylinder. The auxiliary crane is operated to lift the supporting leg and place the same onto a transport tool.

Fourth step, the posture of the operation part of the auxiliary crane is adjusted, or the operation position of the auxiliary crane is adjusted to demount the remaining supporting legs until the supporting legs are all demounted.

Fifth step, the auxiliary crane resets, and the main crane and a transport vehicle head for the operation site together.

After arriving in the vicinity of the operation site, the supporting legs are mounted in place in sequence; and at this time, the crane can start working. In the prior art, the specific implementation and steps of mounting the supporting legs are as follows:

First step, the main crane stops in an area in which it is convenient for the operation of the auxiliary crane.

Second step, the auxiliary crane arrives at a proper position, prepares for lifting, lifts the supporting leg from the transport tool, selects a proper lifting height and posture, aligns the supporting leg to a pin shaft hole on the vehicle frame and inserts the pin shaft in the mechanical manner or the hydraulic manner. If the auxiliary crane is the irremovable crane, the auxiliary crane also needs to carry out such operations as adjusting the posture after arriving at the proper position.

Third step, the pipeline and the like between the supporting leg and the vehicle frame are connected, and then one swing supporting leg (or a fixed supporting leg connected by the pin shaft) is mounted.

Fourth step, the posture of the operation part of the auxiliary crane is adjusted, or the operation position of the auxiliary crane is adjusted to mount the next supporting leg until the supporting legs are all mounted.

Fifth step, the auxiliary crane resets, and the auxiliary crane and the transport vehicle evade an operation space.

Sixth step, the main crane adjusts the movable supporting leg, locates in a travelling state, arrives at a proper operation position and lifts the supporting leg, and the operation part of the main crane is operated to carry out the lifting operation.

The inventor finds that at least the following problems exist in the prior art:

When the existing wheeled crane is in the travelling state, some supporting legs need to be demounted to be separately transported; and during the operation, the demounted parts are assembled to complete the lifting operation. Usually, the auxiliary crane completes the demounting and mounting operations of the supporting legs of the crane, thus the demounting and mounting operations are troublesome, which not only increases the operation cost, but also wastes time, moreover, the dependency is high, and the operation space requirements are high.

SUMMARY OF THE INVENTION

One purpose of the present invention is to provide a wheeled crane and self-demounting and self-mounting methods for supporting legs thereof, in order to conveniently demount and mount the supporting legs on the wheeled crane.

To achieve the aforementioned purpose, embodiments of the present invention provide the following technical solutions:

The embodiments of the present invention provide a wheeled crane, including a vehicle frame and auxiliary supports, wherein the auxiliary supports can enable the vehicle frame to keep balance.

According to the wheeled crane as mentioned above, preferably, a plurality of auxiliary supports are provided, and the auxiliary supports support the vehicle frame together to enable the vehicle frame to keep balance.

According to the wheeled crane as mentioned above, preferably, the auxiliary supports are supporting legs in connected states on the wheeled crane, and the supporting legs can change their own positions and/or angles relative to the vehicle frame to enable the vehicle frame to keep balance.

According to the wheeled crane as mentioned above, preferably, the wheeled crane further includes supporting legs, and the auxiliary supports and the supporting legs support the vehicle frame together to enable the vehicle frame to keep balance.

According to the wheeled crane as mentioned above, preferably, the supporting legs are detachably connected with the vehicle frame, the auxiliary supports are connected to the vehicle frame, and the auxiliary supports are near the supporting legs; and the supporting legs are selected from to-be-mounted supporting legs and to-be-demounted supporting legs on the wheeled crane.

According to the wheeled crane as mentioned above, preferably, there is at least one auxiliary support.

According to the wheeled crane as mentioned above, preferably, the auxiliary supports are fixedly connected with the vehicle frame or the auxiliary supports are movable.

According to the wheeled crane as mentioned above, preferably, the pipelines between the supporting legs and the vehicle frame are connected by a fast insertion structure.

According to the wheeled crane as mentioned above, preferably, the auxiliary supports are tires.

The embodiments of the present invention further provide a self-demounting method for the supporting legs of the wheeled crane, including the following steps:

employing the auxiliary supports to enable the vehicle frame of the wheeled crane to keep balance;

employing an operation part of the wheeled crane to lift the to-be-demounted supporting leg, and demounting a connecting piece between the supporting leg and the vehicle frame of the wheeled crane; and lifting the demounted supporting leg onto a transport tool.

According to the self-demounting method for the supporting legs of the wheeled crane as mentioned above, preferably, the employing the auxiliary supports to enable the vehicle frame of the wheeled crane to keep balance includes one of the following manners:

singly employing the auxiliary supports to enable the vehicle frame to keep balance;

employing the auxiliary supports and non-demounted supporting legs on the wheeled crane to enable the vehicle frame to keep balance together; and the auxiliary supports are the non-demounted supporting legs on the wheeled crane, and changing the positions and/or angles of the supporting legs relative to the vehicle frame to enable the vehicle frame to keep balance.

According to the self-demounting method for the supporting legs of the wheeled crane as mentioned above, preferably, the demounting a connecting piece between the supporting leg and the vehicle frame of the wheeled crane includes:

demounting the connecting piece between the supporting leg and the vehicle frame of the wheeled crane in a mechanical manner, a hydraulic manner, a pneumatic manner or an electrical manner.

According to the self-demounting method for the supporting legs of the wheeled crane as mentioned above, preferably, after the lifting the demounted supporting leg onto a transport tool, the method further includes:

detecting whether the wheeled crane with the supporting leg demounted can keep balance, if not, at least employing one of the following manners to enable the vehicle frame to keep balance: adjusting the positions and/or states of the auxiliary supports, or adjusting the positions and/or angles of the non-demounted supporting legs; and rotating the operation part of the wheeled crane for a certain angle, and demounting the next supporting leg until all the supporting legs are demounted.

The embodiments of the present invention further provide a self-mounting method for the supporting legs of the wheeled crane, including the following steps:

employing the auxiliary supports to enable the vehicle frame of the wheeled crane to keep balance; and employing the operation part of the wheeled crane to lift the to-be-mounted supporting leg, and mounting the supporting leg on the vehicle frame.

According to the self-mounting method for the supporting legs of the wheeled crane as mentioned above, preferably, the employing the auxiliary supports to enable the vehicle frame of the wheeled crane to keep balance includes one of the following manners:

singly employing the auxiliary supports to enable the vehicle frame to keep balance;

employing the auxiliary supports and non-demounted supporting legs on the wheeled crane to enable the vehicle frame to keep balance together; and the auxiliary supports are the non-demounted supporting legs on the wheeled crane, and changing the positions and/or angles of the supporting legs relative to the vehicle frame to enable the vehicle frame to keep balance.

According to the self-mounting method for the supporting legs of the wheeled crane as mentioned above, preferably, the employing the operation part of the wheeled crane to lift the supporting leg, and mounting the supporting leg on the vehicle frame includes:

lifting the supporting leg to a necessary height;

aligning a pin shaft hole in the supporting leg with the pin shaft hole in the vehicle frame;

inserting a pin shaft in a mechanical manner, a hydraulic manner, a pneumatic manner or an electrical manner; and connecting the pipelines between the supporting leg and the vehicle frame.

According to the self-mounting method for the supporting legs of the wheeled crane as mentioned above, preferably, the connecting the pipelines between the supporting leg and the vehicle frame includes:

connecting the pipelines between the supporting leg and the vehicle frame by employing a fast insertion structure.

According to the self-mounting method for the supporting legs of the wheeled crane as mentioned above, preferably, after the employing the operation part of the wheeled crane to lift the to-be-mounted supporting leg, and mounting the supporting leg on the vehicle frame, the method further includes:

detecting whether the wheeled crane with the supporting leg mounted can keep balance, if not, at least employing one of the following manners to enable the vehicle frame to keep balance: adjusting the positions and/or states of the auxiliary supports, or adjusting the positions and/or angles of supporting legs connected with the vehicle frame; and rotating the operation part of the wheeled crane for a certain angle, and mounting the next supporting leg until all the supporting legs are mounted.

Based on the aforementioned technical solutions, the embodiments of the present invention can at least produce the following beneficial effects:

Since the wheeled crane provided by the aforementioned technical solutions has the auxiliary supports, when the supporting legs are demounted or mounted, the auxiliary supports can play supporting roles, so that the supporting legs can be mounted or demounted by the operation part of the wheeled crane with no need of using an auxiliary crane anymore, and thus the self-mounting and self-demounting of the supporting legs of the wheeled crane are realized. It can be understood that when the wheeled crane requires maintenance, even if the supporting legs are out of order and cannot stretch out, the auxiliary supports can also be lifted up to improve the maintenance convenience.

REFERENCE SIGNS

1. vehicle frame; 2. supporting leg; 3. auxiliary support; 4. operation part; 5. non-demounted supporting leg; 11. supporting leg;

12. operation part; 13. chassis; 14. weight;

15. swing supporting leg; 16. telescopic supporting leg; 31 fixed supporting leg;

32. vehicle frame; 33. pin shaft; 41. main crane; and

42. auxiliary crane.

DETAILED DESCRIPTION OF THE EMBODIMENTS

The technical solutions provided by the present invention will be illustrated in more details in combination with FIG. 5 to FIG. 8, and technical solutions obtained by replacing any technical means provided by the present invention or combining two or more arbitrary technical means or technical features provided by the present invention shall all fall within the protection scope of the present invention.

Embodiments of the present invention provide a wheeled crane, which can keep balance consistently, so that supporting legs are demounted or mounted just by using an operation part of the wheeled crane, and self-support maintenance of the wheeled crane can also be realized, and multiple embodiments are given herein for illustration.

Embodiment 1

The first embodiment of the present invention provides a wheeled crane, including a vehicle frame 1 and auxiliary supports 3, wherein the auxiliary supports 3 can enable the vehicle frame 1 to keep balance.

In the embodiment, the auxiliary supports 3 and supporting legs 2 in a connected state with the vehicle frame 1 provide four or more supporting points together to enable the vehicle frame of the wheeled crane to keep balance. Due to the four or more supporting points, the wheeled crane can consistently keep a relatively stable state, and the arrangement positions of the auxiliary supports 3 are relatively easier. If three-point support is employed, the arrangement positions of the auxiliary supports 3 need to be accurately selected.

Taking it as an example that the wheeled crane has four supporting legs, when two supporting legs need to be demounted, for example, one front supporting leg and one back supporting leg or two supporting legs on the front or two supporting legs on the back are respectively demounted, and the number of the auxiliary supports 3 is preferably not less than the number of the to-be-demounted supporting legs.

Figure 1:
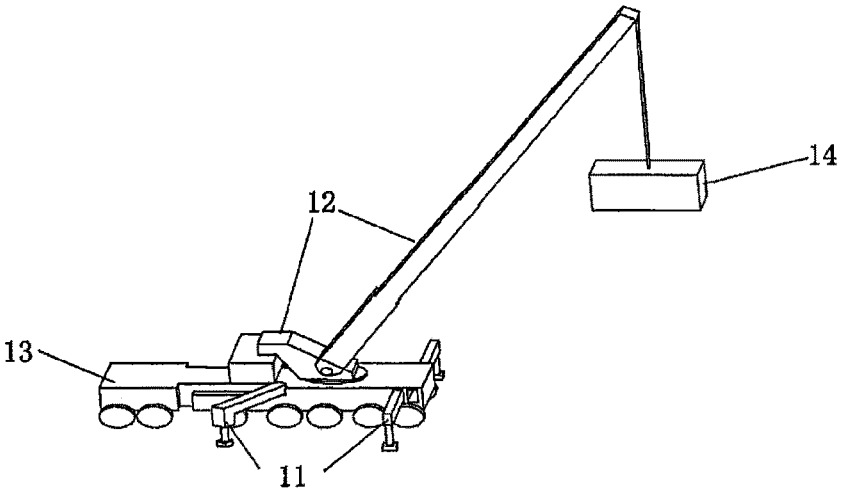
FIG. 1 is a schematic diagram of a lifting operation state of a wheeled crane in the prior art.
Figure 2A:
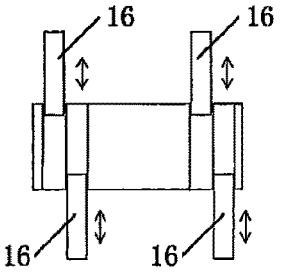
FIG. 2*a* is a structural schematic diagram of H-shaped supporting legs on the wheeled crane in the prior art.
Figure 2B:
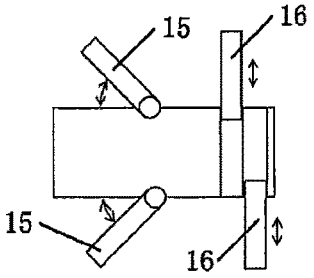
FIG. 2*b* is a structural schematic diagram of K-shaped supporting legs on the wheeled crane in the prior art.
Figure 2C:
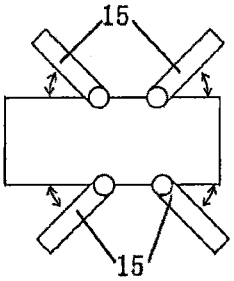
FIG. 2*c* is a structural schematic diagram of X-shaped supporting legs on the wheeled crane in the prior art.
Figure 3A:
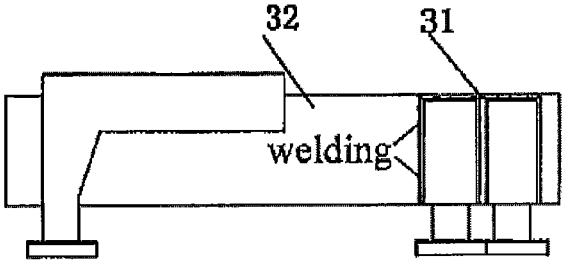
FIG. 3*a* is a schematic diagram of welding between fixed supporting legs and a vehicle frame of the wheeled crane in the prior art.
Figure 3B:
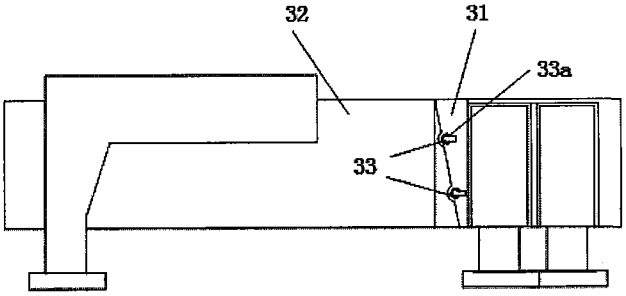
FIG. 3*b* is a schematic diagram of pin shaft connection between the fixed supporting legs and the vehicle frame of the wheeled crane in the prior art.
Figure 4:
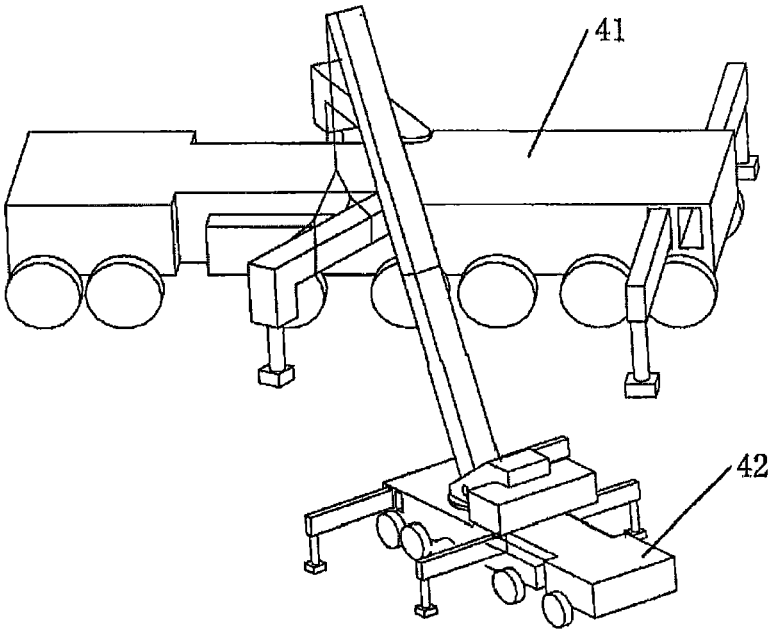
FIG. 4 is a schematic diagram of demounting and mounting of the supporting leg of the wheeled crane in the prior art.
Figure 5:
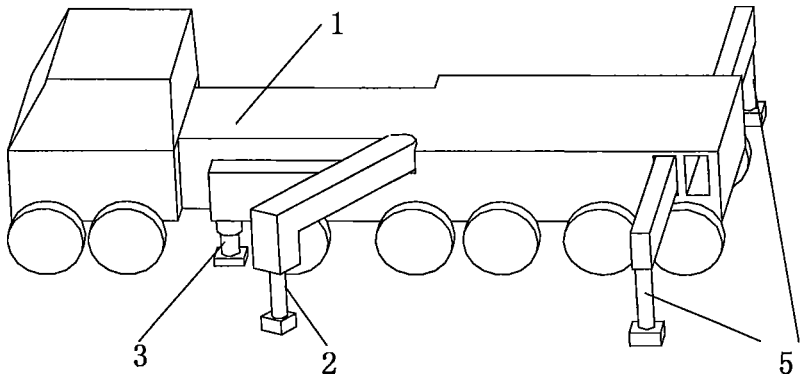
FIG. 5 is a structural schematic diagram of a wheeled crane provided by embodiment 1 of the present invention.
Figure 6:
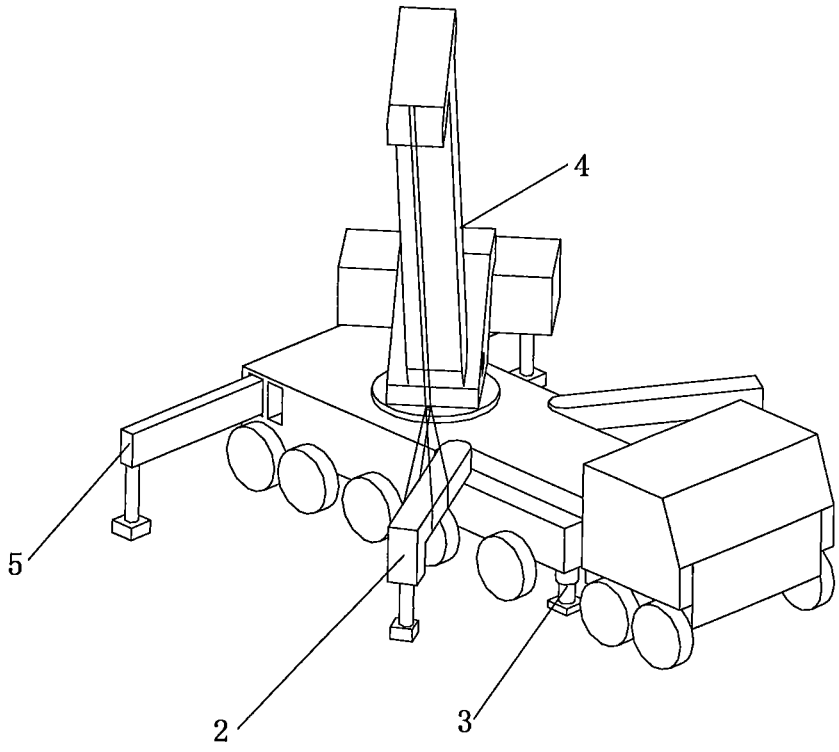
FIG. 6 is a schematic diagram of demounting and mounting of the supporting legs of the wheeled crane provided by embodiment 1 of the present invention.

Detailed introduction will be given below in combination with FIG. 5 and FIG. 6. The wheeled crane provided by embodiment 1 of the present invention includes the vehicle frame 1, the supporting legs 2 and the auxiliary supports 3. The supporting legs 2 are detachably connected with the vehicle frame 1, the auxiliary supports 3 are connected with the vehicle frame 1, and the auxiliary supports 3 are in the vicinity of the supporting legs 2. The supporting legs 2 are selected from to-be-mounted supporting legs and to-be-demounted supporting legs on the wheeled crane. That is, the auxiliary supports 3 are in the vicinity of the to-be-mounted supporting legs or the to-be-demounted supporting legs.

The supporting legs are supporting mechanisms during the operations of the wheeled crane for supporting the crane or weights. According to whether front and back supporting legs need to extend and retract (or swing), the supporting legs are divided into movable supporting legs and fixed supporting legs. The supporting legs 2 in the embodiment specifically refer to movable supporting legs and those supporting legs needing to be demounted or mounted in the fixed supporting legs connected with the main body of the vehicle frame 1 by pin shafts, that is, the to-be-mounted supporting legs and the to-be-demounted supporting legs. For example, for a wheeled crane having four movable supporting legs, the number of the to-be-demounted supporting legs is not limited during transport. The supporting legs 2 in the embodiment specifically refer to the to-be-demounted supporting legs during a demounting operation and specifically refer to the to-be-mounted supporting legs during a mounting operation.

In the embodiment, when the supporting legs of the crane are demounted/mounted, the auxiliary supports 3 temporarily replace the supporting legs to function as the supporting mechanisms. The auxiliary supports 3 can also employ structures similar to the supporting legs, or other structures with enough carrying capacity.

The auxiliary supports 3 play the same role as the supporting legs, so that when the to-be-demounted supporting legs in the vicinity of the auxiliary supports 3 are demounted, the stability of the crane is guaranteed; or when the to-be-mounted supporting legs are mounted, the auxiliary supports function as supporting the crane.

Since the wheeled crane provided by the aforementioned technical solution has the auxiliary supports 3, when the to-be-demounted supporting legs are demounted or the to-be-mounted supporting legs are mounted, the auxiliary supports 3 can function as the supporting legs, so that the supporting legs can be mounted or demounted by the operation part 4 of the wheeled crane with no need of using an auxiliary crane, and thus the self-mounting and self-demounting of the supporting legs of the wheeled crane are realized. It can be understood that when the wheeled crane requires maintenance, even if the supporting legs are out of order and cannot stretch out, the auxiliary supports 3 can also be lifted up to improve the maintenance convenience.

There is at least one auxiliary support 3. The auxiliary supports 3 are arranged in the vicinity of the to-be-demounted supporting legs. Of course, the auxiliary supports 3 can also be arranged at other positions where the vehicle frame 1 can keep balance.

When the number and the distribution positions of the auxiliary supports 3 are determined, the stability of the lifting operation of the whole crane needs to be fully considered. According to different demounting and mounting forms of the supporting legs, the following three conditions can be contained:

First, when two swing supporting legs of K-shaped supporting legs or two front (or two back) swing supporting legs of X-shaped supporting legs are demounted and mounted, the auxiliary supports 3 are placed at positions in the vicinity of supporting leg disks or other reasonable positions when the to-be-demounted supporting legs retract, and 2 or other numbers of auxiliary supports 3 are used in general.

Second, when back fixed supporting legs of the K-shaped supporting legs or connected with H-shaped pin shafts are demounted and mounted, the auxiliary supports 3 are placed at positions in the vicinity of fixed supporting legs or other reasonable positions on the main body of the vehicle frame 1, and 2 or other numbers of auxiliary supports 3 are used in general.

The auxiliary supports 3 and the vehicle frame 1 can be fixedly connected or detachably connected.

Specifically, the auxiliary supports 3 fixed with the vehicle frame 1 can be fixed on proper positions on the vehicle frame 1 or other components fixed with the vehicle frame 1. The auxiliary supports 3 detachably connected with the vehicle frame 1 can be separated from the vehicle frame 1 and meanwhile can be quickly connected with the vehicle frame 1. No matter the auxiliary supports 3 in which aforementioned forms are adopted, hydraulic supports or mechanical supports or the like can be employed.

To improve the demounting and mounting efficiency of the supporting legs 2, the pipelines between the supporting legs 2 and the vehicle frame 1 are connected by a fast insertion structure, in order to quickly and conveniently demount and mount the pipelines.

As mentioned above, the auxiliary supports 3 can employ a variety of structures, and the auxiliary supports 3 can be special tires as an example.

The tires herein can be walking tires of the wheeled crane, for example, when the two front supporting legs are demounted, two front walking tires and two back non-demounted supporting legs form four-point support together to realize the self-mounting of the front supporting legs, for example, when two back supporting legs are demounted, two back walking tires and two front non-demounted supporting legs form four-point support together to realize the self-demounting of the back supporting legs.

Embodiment 2

In the embodiment, the auxiliary supports 3 are singly employed to enable the wheeled crane to consistently keep balance, and the auxiliary supports 3 have a variety of implementation forms, for example, tires, supporting leg structures similar to the supporting legs or the like. If all the auxiliary supports 3 are used, the necessary space is small. Moreover, since the auxiliary supports 3 can stably support the wheeled crane, when the wheeled crane is out of order, the auxiliary supports 3 can be directly used for supporting the wheeled crane to maintain the wheeled crane, and thus it can be avoided that the wheeled crane is supported by other auxiliary equipment.

There are preferably four or more auxiliary supports 3, so that the wheeled crane is always in a four or more-point supporting state.

The auxiliary supports 3 can be movable and can be provided with a plurality of mounting positions. When the auxiliary supports 3 need to be used, the auxiliary supports 3 are mounted on the necessary positions and are accommodated when not in use. When different supporting legs 2 are demounted and mounted, the positions of some or all of the auxiliary supports 3 can be adjusted to enable the vehicle frame 1 to always keep a relatively stable balance state so as to improve the safety.

Embodiment 1 and embodiment 2 are specifically illustrated below in view of forms of the supporting legs:

1. H-shaped supporting leg 1.1. Demounting and mounting of one movable supporting leg (one front supporting leg/one back supporting leg):

The number of the auxiliary supports: at least one.

The demounting and mounting method: when only one auxiliary support is employed, the auxiliary support supports with the remaining three non-demounted supporting legs together; and when two auxiliary supports are employed, the auxiliary supports can be combined with two (or three) non-demounted supporting legs.

When three auxiliary supports are employed, the auxiliary supports can be combined with one (or two or three) non-demounted supporting leg.

When four (or more than four) auxiliary supports are employed, all the auxiliary supports are used for supporting without being combined with the non-demounted supporting legs, and of course, the auxiliary supports can also be combined with the non-demounted supporting legs to support together.

1.2. Demounting and mounting of two movable supporting legs (two front supporting legs/two back supporting legs/one front supporting leg and one back supporting leg):

The number of the auxiliary supports: at least two auxiliary supports are needed.

The demounting and mounting method: when two auxiliary supports are employed, the auxiliary supports form support with the remaining two non-demounted supporting legs.

When three auxiliary supports are employed, the auxiliary supports are combined with one non-demounted supporting leg.

When four (or more than four) auxiliary supports are employed, all the auxiliary supports are used for supporting without being combined with the non-demounted supporting legs, and of course, the auxiliary supports can also be combined with the non-demounted supporting legs to support together.

1.3. Demounting and mounting of three movable supporting legs (two front supporting legs and one back supporting leg/two back supporting legs/one front supporting leg):

The number of the auxiliary supports: at least three auxiliary supports are needed.

When three auxiliary supports are employed, the auxiliary supports are combined with one non-demounted supporting leg to support together.

When four (or more than four) auxiliary supports are employed, all the auxiliary supports are used for supporting without being combined with the non-demounted supporting legs, and of course, the auxiliary supports can also be combined with the non-demounted supporting legs to support together.

1.4. Demounting and mounting of four movable supporting legs:

The number of the auxiliary supports: at least four auxiliary supports are needed.

When four (or more than four) auxiliary supports are employed, all the auxiliary supports are used.

1.5. Demounting and mounting of one fixed supporting leg (including two movable supporting legs therein): being the same as 1.2.

1.6. Demounting and mounting of two fixed supporting legs (including four movable supporting legs therein): being the same as 1.4.

2. K-shaped supporting leg 2.1. Demounting and mounting of one movable supporting leg (one front supporting leg/one back supporting leg): being the same as 1.1.

2.2. Demounting and mounting of two movable supporting legs (two front supporting legs/two back supporting legs/one front supporting leg and one back supporting leg): being the same as 1.2.

2.3. Demounting and mounting of three movable supporting legs (two front supporting legs and one back supporting leg/two back supporting legs/one front supporting leg): being the same as 1.3.

2.4. Demounting and mounting of four movable supporting legs: being the same as 1.4.

2.5. Demounting and mounting of fixed supporting legs (including two movable supporting legs therein): being the same as 1.5.

3. X-shaped supporting leg 3.1. Demounting and mounting of one movable supporting leg (one front supporting leg/one back supporting leg): being the same as 1.1.

3.2. Demounting and mounting of two movable supporting legs (two front supporting legs/two back supporting legs/one front supporting leg and one back supporting leg): being the same as 1.2.

3.3. Demounting and mounting of three movable supporting legs (two front supporting legs and one back supporting leg/two back supporting legs/one front supporting leg): being the same as 1.3.

3.4. Demounting and mounting of four movable supporting legs: being the same as 1.4.

Embodiment 3

In the embodiment, the vehicle frame of the wheeled crane consistently keeps balance in the following manner: the auxiliary supports 3 are the supporting legs 2 in the connected state on the wheeled crane, and the supporting legs 2 can change their own positions and/or angles relative to the vehicle frame 1 to enable the vehicle frame 1 to keep balance.

Preferably, the wheeled crane has five or more supporting legs, so that the wheeled crane is consistently located in a four or more-point supporting state.

When different supporting legs 2 are demounted, the stretching or swinging positions of the non-demounted supporting legs 2 are adjusted to improve safety.

It should be noted that: when a plurality of supporting legs (e.g., first supporting legs and second supporting legs) are demounted and mounted, when the first supporting legs are demounted, the second supporting legs can play a role of supporting, and one auxiliary support can be reduced to improve safety; and when the second supporting legs are mounted, the first supporting legs can play a role of supporting, and one auxiliary support can also be reduced to improve safety.

The placement positions of the auxiliary supports: in the vicinity of the to-be-mounted supporting leg or other positions where the supporting roles can be played.

Embodiment 4

Figure 7:
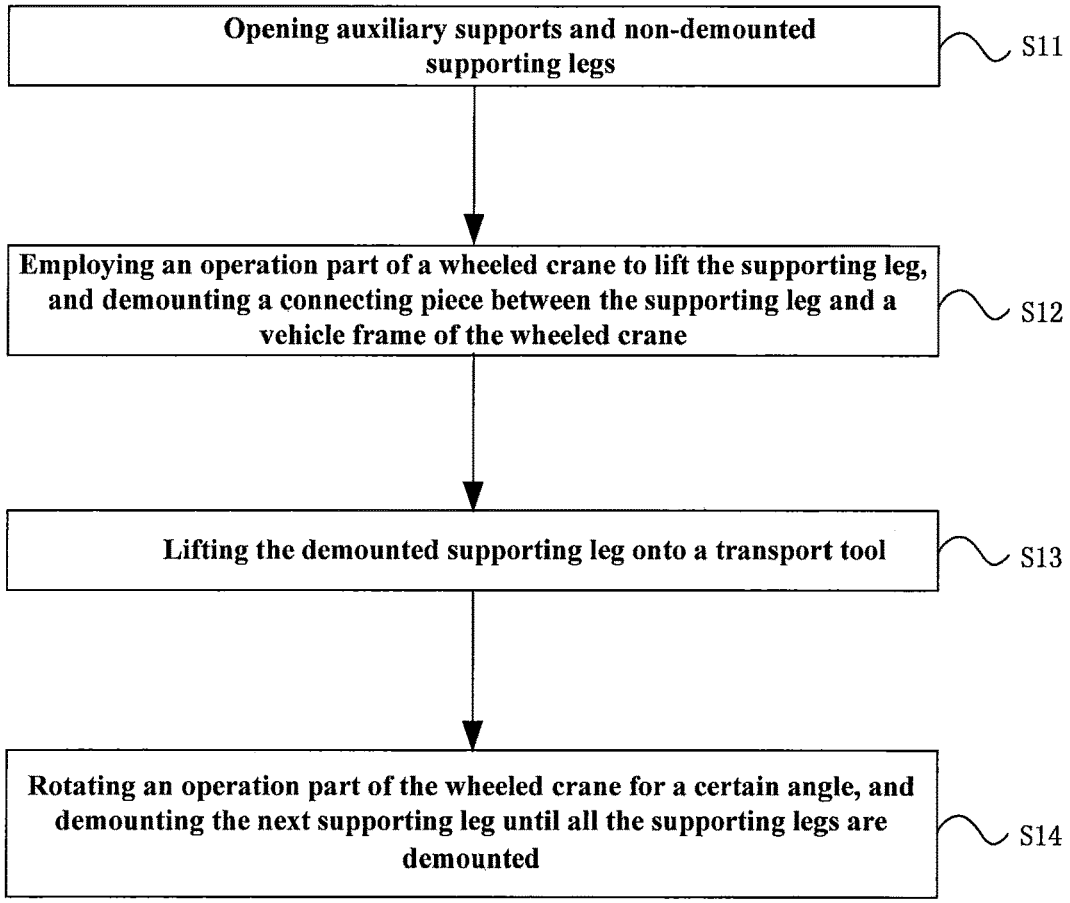
FIG. 7 is a schematic flow diagram of a self-demounting method for supporting legs of a wheeled crane provided by embodiment 4 of the present invention.

The fourth embodiment of the present invention provides a self-demounting method for the supporting legs of the wheeled crane. Preferably, the method is implemented by the wheeled crane in any technical solution provided by the present invention. Referring to FIG. 6 and FIG. 7, the self-demounting method includes the following steps:

Step S11: the auxiliary supports and the non-demounted supporting legs are all opened to bear the weight of the whole crane, and at this time, the auxiliary supports function as the supporting legs.

It should be noted that the auxiliary supports can be employed to enable the vehicle frame of the wheeled crane to keep balance in a variety of manners, besides the manner in step S11, the following several manners can also be employed: the auxiliary supports are singly employed to enable the vehicle frame to keep balance; the auxiliary supports and the non-demounted supporting legs on the wheeled crane are employed together to enable the vehicle frame to keep balance, and this manner is taken as an example in the embodiment; and the auxiliary supports are the non-demounted supporting legs on the wheeled crane, and the positions and/or angles of the supporting legs relative to the vehicle frame are changed to enable the vehicle frame to keep balance.

If all the auxiliary supports are employed, the necessary space is small, and moreover, the wheeled crane can be maintained without using other lifting equipment. The manner of combining the auxiliary supports with the non-demounted supporting legs is good in stability and high in safety; and meanwhile, when different supporting legs are demounted, different combination forms can be employed, and thus the flexibility is good.

It should be noted that when different supporting legs are demounted, the positions of the auxiliary supports detachably connected with the vehicle frame can be adjusted to improve safety.

In addition, when different supporting legs are demounted, the stretching or swinging positions of the non-demounted supporting legs are adjustable, and the safety can also be improved in this way.

In the embodiment, it is taken as an example that the auxiliary supports and the non-demounted supporting legs on the wheeled crane are employed together to enable the vehicle frame to keep balance. As mentioned above, the auxiliary supports 3 can be fixedly connected or detachably connected with the vehicle frame 1, if the auxiliary supports 3 detachably connected with the vehicle frame 1 are employed herein, the auxiliary supports 3 need to be mounted on the vehicle frame 1 in advance, and then the auxiliary supports 3 are opened.

Prior to or after step S11, the connection oil pipes of the supporting legs 2 and other accessories can also be demounted.

Step S12: the to-be-demounted supporting leg is lifted by the operation part of the wheeled crane, and a connecting piece between the supporting leg and the vehicle frame of the wheeled crane is demounted; and the operation part 4 of the wheeled crane is operated to lift the supporting leg 2, and the connecting pin shaft between the supporting leg 2 and the vehicle frame 1 is pulled out in a mechanical manner or a hydraulic manner, so that there is no connecting part between the supporting leg 2 and the vehicle frame 1.

Step S13: the demounted supporting leg is lifted onto a transport tool.

In step S13, the demounted supporting leg is lifted in a normal operation mode and is placed on the transport tool, and then the demounting of one swing supporting leg (or a fixed supporting leg connected by the pin shaft) is completed.

When there is more than one supporting leg 2, after the demounted supporting leg 2 is lifted onto the transport tool, the method further includes:

Step S14: the operation part of the wheeled crane is rotated for a certain angle to demount the next supporting leg until all the supporting legs are demounted.

It should be noted that prior to step S14, if the stability of the wheeled crane cannot be guaranteed, the positions and open/closed states of the auxiliary supports can be adjusted; and the stretching or swinging positions and the open/closed states of the auxiliary supports can also be adjusted, in order to enable the vehicle frame to consistently keep balance. That is, prior to step S14, the method can further include the following steps: detecting whether the wheeled crane with the supporting leg demounted can keep balance, if not, at least employing one of the following manners to enable the vehicle frame to keep balance: adjusting the positions and/or states of the auxiliary supports, or adjusting the positions and/or angles of the non-demounted supporting legs.

After all the supporting legs 2 are demounted, the operation part 4 of the wheeled crane needs to reset, all the non-demounted supporting legs on the wheeled crane need to be recycled and the auxiliary supports 3 need to be recycled to enable the main crane to have a travelling state and drive to the operation site, and then the supporting legs 2 are mounted. For the auxiliary supports 3 detachably connected with the vehicle frame 1, the auxiliary supports 3 need to be accommodated at first, and then the auxiliary supports 3 are moved away.

According to the self-demounting method for the supporting legs of the wheeled crane provided by the aforementioned technical solutions, the auxiliary supports 3 are combined with the operation part 4 of the crane to realize the self-demounting of the supporting legs 2 of the crane, and the auxiliary mechanical equipment is also reduced, thereby reducing the dependency on other cranes, and reducing the operation cost; and the operation preparation and position transfer time of the auxiliary crane are reduced, and thus the operation efficiency is improved. In addition, the occupied volume of the auxiliary supports 3 is small, and thus the necessary operation space is small during the self-demounting of the supporting legs 2.

Embodiment 5

Figure 8:
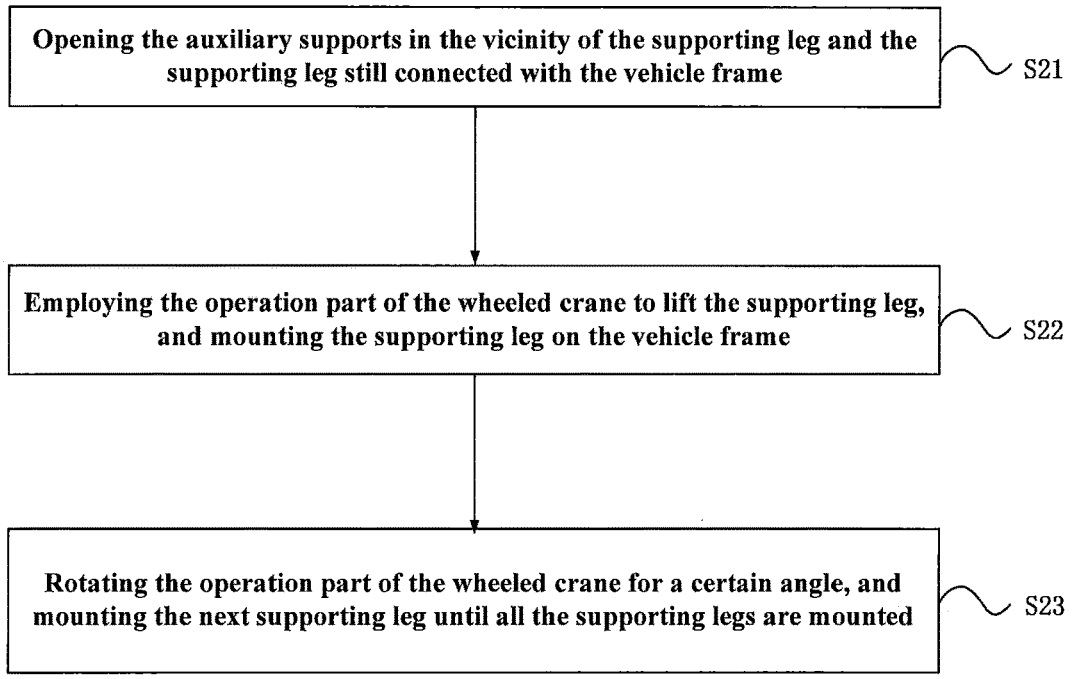
FIG. 8 is a schematic flow diagram of a self-mounting method for the supporting legs of the wheeled crane provided by embodiment 5 of the present invention.

The fifth embodiment of the present invention provides a self-mounting method for the supporting legs of the wheeled crane. Preferably, the method is implemented by the wheeled crane in any technical solution provided by the present invention. The supporting legs 2 of the wheeled crane refer to to-be-mounted supporting legs. Referring to FIG. 6 and FIG. 8, the self-mounting method includes the following steps:

Step S21: the auxiliary supports in the vicinity of the supporting legs and the supporting legs still connected with the vehicle frame are all opened to bear the weight of the whole crane, and at this time, the auxiliary supports function as the supporting legs. If the auxiliary supports are detachably connected with the vehicle frame, the auxiliary supports need to be mounted and placed on predetermined positions, and then the auxiliary supports are opened.

It should be noted that the auxiliary supports are employed to enable the vehicle frame of the wheeled crane to keep balance in a variety of manners, besides the manner in step S21, the following several manners can also be employed: the auxiliary supports are singly employed to enable the vehicle frame to keep balance; or, the auxiliary supports are the non-demounted supporting legs on the wheeled crane, and the positions and/or angles of the supporting legs relative to the vehicle frame are changed to enable the vehicle frame to keep balance.

Step S22: the supporting leg is lifted by the operation part of the wheeled crane, and the supporting leg is mounted on the vehicle frame.

Figure 9:
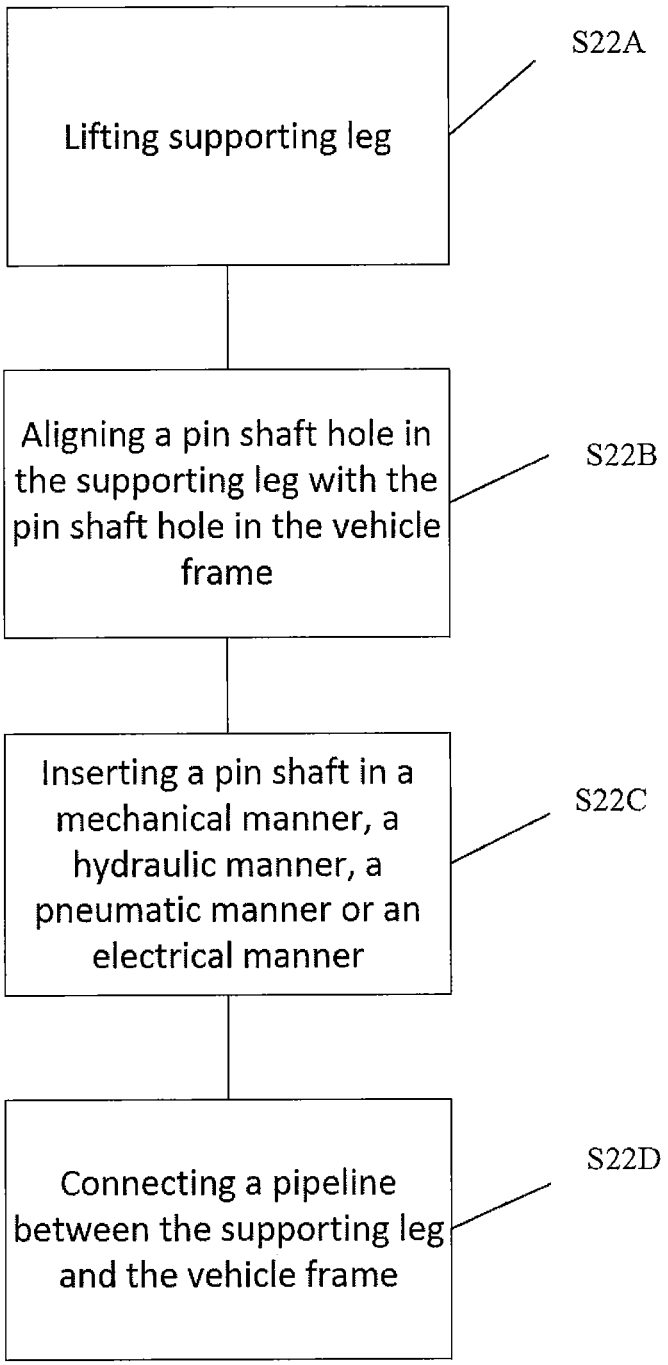
FIG. 9 is a schematic flow diagram of a self-mounting method for the supporting legs of the wheeled crane according to some embodiments of the present invention.

Specifically, as illustrated in FIG. 9, step S22 can include: operating the operation part of the main crane, lifting the supporting leg from the transport equipment (step S22A), lifting the supporting leg in a normal operation manner, selecting a proper lifting height and posture, and lifting the supporting leg to a necessary height; aligning a pin shaft hole in the supporting leg with the pin shaft hole in the vehicle frame (step S22B); inserting a pin shaft in a mechanical manner a mechanical manner, a hydraulic manner, a pneumatic manner, or an electrical manner, (step S22C); and connecting the pipelines between the supporting leg and the vehicle frame (step S22D). So far, the self-mounting of one supporting leg 2 is completed.

The connecting the pipelines between the supporting leg 2 and the vehicle frame 1 is specifically as follows: connecting the pipelines between the supporting leg 2 and the vehicle frame 1 by a fast insertion structure. The mounting efficiency of the pipelines can be improved by employing the fast insertion structure.

For occasions with a plurality of supporting legs 2, after step S22, the method further includes:

step 23: rotating the operation part of the wheeled crane for a certain angle, and mounting the next supporting leg until all the supporting legs are mounted.

It should be noted that prior to step S23, if the stability of the wheeled crane cannot be guaranteed, the positions and open/closed states of the auxiliary supports can be adjusted; and the stretching or swinging positions and the open/closed states of the supporting legs connected with the vehicle frame can also be adjusted, in order to enable the vehicle frame to consistently keep balance. That is, prior to step S23, the method can further include the following steps: detecting whether the wheeled crane with the supporting leg demounted can keep balance, if not, at least employing one of the following manners to enable the vehicle frame to keep balance: adjusting the positions and/or states of the auxiliary supports, or adjusting the positions and/or angles of the supporting legs connected with the vehicle frame.

After all the supporting legs 2 are mounted, the following operations can also be carried out: the operation part 4 of the wheeled crane reset; all the supporting legs 2 on the wheeled crane and the original supporting legs are at working positions; and the auxiliary supports 3 are recycled. If the auxiliary supports 3 are detachably connected with the vehicle frame 1, the auxiliary supports 3 need to be accommodated at first, then the auxiliary supports 3 are moved away, and the operation part 4 is adjusted to carry out the lifting operation.

According to the self-mounting method for the supporting legs of the wheeled crane provided by the aforementioned technical solutions, the auxiliary supports 3 are combined with the operation part 4 of the crane to realize the self-mounting of the supporting legs 2 of the crane, and the auxiliary mechanical equipment is also reduced, thereby reducing the dependency on other cranes, and reducing the operation cost; and the operation preparation and position transfer time of the auxiliary crane are reduced, and thus the operation efficiency is improved. In addition, the occupied volume of the auxiliary supports 3 is small, and thus the necessary operation space is small during the self-mounting of the supporting legs 2.

In the description of the present invention, it should be understood that the terms "center", "longitudinal", "transverse", "front", "back", "left", "right", "vertical", "horizontal", "top", "bottom", "inside", "outside" and other terms indicating direction or position relationships are direction or position relationships based on what are shown in the figures, are merely used for describing the present invention and simplifying the description, rather than indicating or implying that the indicated devices or elements must have specific directions or be constructed and operated in specific directions, and thus cannot be understood as limitations to the protection scope of the present invention.

Finally, it should be noted that the above-mentioned embodiments are merely used for illustrating the technical solutions of the present invention, rather than limiting them; although the present invention has been described in detail with reference to the preferred embodiments, those of ordinary skill in the art should understand that they could still make modifications to the specific implementations of the present invention or make equivalent substitutions to a part of technical features therein; and these modifications or substitutions shall all fall within the scope of the technical solutions of the present invention without departing from the spirit of the technical solutions of the present invention.

The invention claimed is:

1. A self-mounting method for supporting legs of a wheeled crane, comprising the following steps:

employing auxiliary supports to enable a vehicle frame of the wheeled crane to keep balance; and employing an operation part of the wheeled crane to lift the supporting leg, and mounting the supporting leg on the vehicle frame;

wherein the employing the auxiliary supports to enable the vehicle frame of the wheeled crane to keep balance comprises one of the following manners:

singly employing the auxiliary supports to enable the vehicle frame to keep balance;

employing the auxiliary supports and non-demounted supporting legs on the wheeled crane to enable the vehicle frame to keep balance together; and the auxiliary supports are the non-demounted supporting legs on the wheeled crane, and changing the positions and/or angles of the supporting legs relative to the vehicle frame to enable the vehicle frame to keep balance, wherein after the employing the operation part of the wheeled crane to lift the to-be-mounted supporting leg, and mounting the supporting leg on the vehicle frame, the method further comprises:

detecting whether the wheeled crane with the mounted supporting leg can keep balance, and if the wheeled crane with the mounted supporting leg cannot keep balance, at least employing one of the following manners to enable the vehicle frame to keep balance: adjusting the positions and/or states of the auxiliary supports, or adjusting the positions and/or angles of the supporting legs connected with the vehicle frame; and rotating the operation part of the wheeled crane for a certain angle, and mounting the next supporting leg until all the supporting legs are mounted.

2. The self-mounting method for the supporting legs of the wheeled crane of claim 1, wherein the step of employing the operation part of the wheeled crane to lift the to-be-mounted supporting leg, and mounting the supporting leg on the vehicle frame comprises:

lifting the supporting leg to a necessary height;

aligning a pin shaft hole in the supporting leg with the pin shaft hole in the vehicle frame;

inserting a pin shaft in a mechanical manner, a hydraulic manner, a pneumatic manner or an electrical manner; and connecting a pipelines between the supporting leg and the vehicle frame.

3. The self-mounting method for the supporting legs of the wheeled crane of claim 2, wherein the step of connecting the pipelines between the supporting leg and the vehicle frame comprises:

connecting the pipelines between the supporting leg and the vehicle frame by employing a fast insertion structure.

* * * * *